US009226529B2

(12) United States Patent
Monahon

(10) Patent No.: US 9,226,529 B2
(45) Date of Patent: Jan. 5, 2016

(54) BIB WITH EXTENDABLE POUCH

(71) Applicant: Cne A. Monahon, Austin, TX (US)

(72) Inventor: Cne A. Monahon, Austin, TX (US)

( * ) Notice: Subject to any disclaimer, the term of this patent is extended or adjusted under 35 U.S.C. 154(b) by 268 days.

(21) Appl. No.: 13/875,612

(22) Filed: May 2, 2013

(65) Prior Publication Data

US 2013/0291276 A1 Nov. 7, 2013

Related U.S. Application Data

(60) Provisional application No. 61/642,272, filed on May 3, 2012.

(51) Int. Cl.
*A41B 13/10* (2006.01)
*A41B 13/04* (2006.01)

(52) U.S. Cl.
CPC ..... *A41B 13/103* (2013.01); *A41B 13/04* (2013.01); *A41B 13/106* (2013.01)

(58) Field of Classification Search
CPC ..... A41B 13/04; A41B 13/103; A41B 13/106
USPC ..... 2/48, 49.1–49.5, 50–52, 57, 174, 2/247–252, 255–257, 259, 260, 260.1, 2/262–264, 271; D2/860–864
See application file for complete search history.

(56) References Cited

U.S. PATENT DOCUMENTS

| | | | | |
|---|---|---|---|---|
| 996,084 | A * | 6/1911 | Herring | 2/49.2 |
| 1,592,283 | A * | 7/1926 | McKenzie | 2/48 |
| 2,672,614 | A * | 3/1954 | Zimmerman et al. | 2/49.3 |
| 3,407,407 | A * | 10/1968 | Hollander et al. | 2/49.2 |
| 3,597,763 | A | 8/1971 | Bienvenu | |
| 4,860,381 | A | 8/1989 | Bartley | |
| 5,671,479 | A | 9/1997 | Bedrick | |
| 6,105,165 | A | 8/2000 | Johnson et al. | |
| 8,166,571 | B2 | 5/2012 | Fletcher | |
| 2011/0154552 | A1 * | 6/2011 | Fletcher | 2/48 |

FOREIGN PATENT DOCUMENTS

| | | |
|---|---|---|
| FR | 2844679 | 3/2004 |

OTHER PUBLICATIONS

International Searching Authority: "Notification of Transmittal of the International Search Report and the Written Opinion of the International Searching Authority, or the Declaration"; Sep. 2, 2014.

* cited by examiner

*Primary Examiner* — Khaled Annis
(74) *Attorney, Agent, or Firm* — Bryan W. Bockhop; Bockhop & Assoicates, LLC

(57) ABSTRACT

A bib system includes a liquid resistant flexible body member having a bottom configured to cover a torso of a user extending a lower periphery. A closure system is configured to engage the flexible body member with the torso of the user. A collapsible support structure is integrated with the flexible body member and is coupled to the closure. The collapsible support structure is configured to support the lower periphery of the flexible body member when the closure is engaged so that the bottom of the flexible body member forms an open pouch at the bottom of the flexible body member. The collapsible support structure is also configured not to form the pouch when the flexible body member is not applied around the torso of the user.

16 Claims, 2 Drawing Sheets

BIB WITH EXTENDABLE POUCH

CROSS-REFERENCE TO RELATED APPLICATION(S)

This application claims the benefit of U.S. Provisional Patent Application Ser. No. 61/642,272, filed May 3, 2012, the entirety of which is hereby incorporated herein by reference.

BACKGROUND OF THE INVENTION

1. Field of the Invention

The present invention relates to bibs and, more specifically, to a bib system that forms a pouch when worn by a user.

2. Description of the Related Art

Bibs are typically used to prevent food from staining an infant's clothing. Typical bibs are little more than pieces of cloth or vinyl that protect the clothing. However, such bibs allow food to slide down into the infant's seating area.

Therefore, there is a need for a bib that protects the infant's seating area.

SUMMARY OF THE INVENTION

The disadvantages of the prior art are overcome by the present invention which, in one aspect, is a bib that includes a liquid resistant flexible body member having a bottom configured to cover a torso of a user extending a lower periphery. A closure system is configured to engage the flexible body member with the torso of the user. A collapsible support structure is integrated with the flexible body member and is coupled to the closure. The collapsible support structure is configured to support the lower periphery of the flexible body member when the closure is engaged so that the bottom of the flexible body member forms an open pouch at the bottom of the flexible body member. The collapsible support structure is also configured to not to form the pouch when the flexible body member is not applied around the torso of the user.

In another aspect, the invention is a bib system that includes a liquid resistant flexible fabric body member having a bottom configured to cover a torso of a user and having a lower periphery. The flexible body member defines a pocket adjacent the bottom. A closure system is configured to engage the flexible body member with the torso of the user. A collapsible support structure is integrated with the flexible body member and is coupled to the closure. The collapsible support structure is configured to support the lower periphery of the flexible body member when the closure is engaged so that the bottom of the flexible body member forms an open pouch at the bottom of the flexible body member. The collapsible support structure is also configured to lay substantially flat or slightly bent when the flexible body member is not applied around the torso of the user. The collapsible support structure is configured to fit into the pocket and includes as least a first elongated stiff flexible rib having a first end and an opposite second end. The rib is disposed along the lower periphery of the flexible body member and is configured to form a substantially circular rim configured to support a portion of the bottom of the flexible body member in the shape of a pouch when the closure system draws the first end next to the second end. The pocket includes an opening so as to allow the collapsible support structure to be removable therefrom to facilitate washing of the flexible body member.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
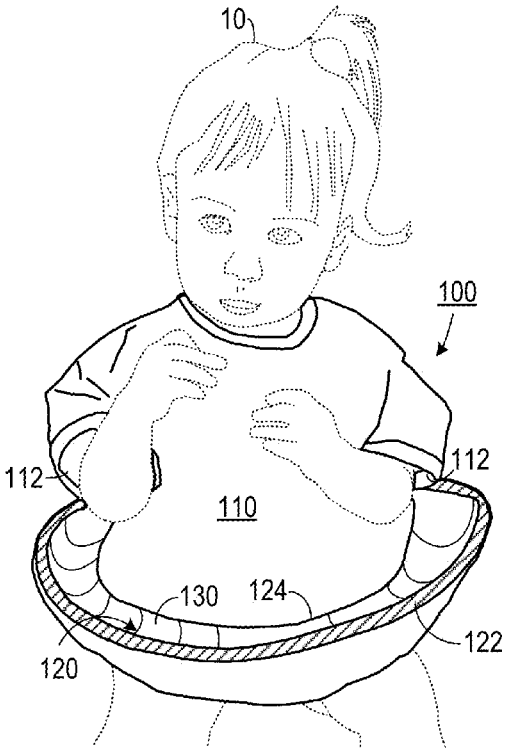
FIG. 1 is a perspective view of one embodiment of a bib during use.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2:
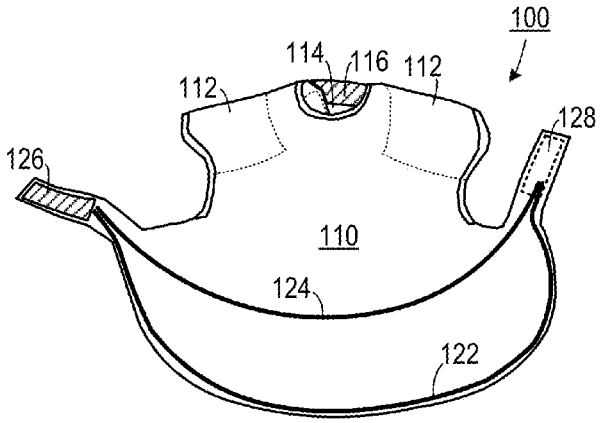
FIG. 2 is an elevational view of the embodiment shown in FIG. 1.

As shown in FIGS. 1 and 2, one embodiment of a bib 100 or an apron to be worn by a user 10, such as an infant, includes a flexible body member 110 configured to cover the torso of the user 10. Two optional sleeve portions 112 may be formed in the flexible body member 110 and are adapted to receive the arms of the user 10 therethrough. A top opening 114 with a closure (such as a strap with a hook and loop fastener, a snap, a hook, a tie or any other securing mechanism) is configured to be placed loosely around the neck of the user 10. The flexible body member 110 includes a water-repellent fabric or sheet material, such as: 100% woven polyester, vinyl, liquid-repellant non-woven fabric, plastic sheet, or any one of the many fabrics that can repel liquids known to the art.

A lower closure system, which could include, e.g. a first tab 126 with a hook and loop fastener portion affixed thereto and a second tab 128 with a complementary hook and loop fastener portion affixed thereto, is configured to secure the bib 100 about the user's 10 waist. A collapsible support structure 120 is used to support a pouch 130 at the bottom of the flexible body member 110. The collapsible support structure 120 may include a first stiff and flexible elongated rod 122 that is affixed to or embedded into the flexible body member 110 adjacent a curved bottom peripheral edge. The first stiff and flexible elongated rod 122 has two opposite ends, each of which is secured to a different one of first tab 126 and the second tab 128, which form a closure system. When the first tab 126 is secured to the second tab 128, an extended portion of the body member 110 is held away from the user's torso and forms the pouch 130 by a portion of the first stiff and flexible elongated rod 122. The pouch 130 is configured to catch such things a spilled liquids and dropped food items therein. In one embodiment, the closure system includes complementary hook and loop fastener. Another closure system can include a cloth strap that is attached to a first side of the flexible body member and a grommet that is attached to a second side, opposite from the first side, of the flexible body member. The grommet defines a hole configure to receive the cloth strap therethrough.

An optional second stiff and flexible elongated rod 124 may be embedded into the flexible body member 110 and spaced apart from the first stiff and flexible elongated rod 122. The second stiff and flexible elongated rod 124 has two opposite ends. A portion of the second stiff and flexible elongated rod 124 is disposed adjacent to each of which is secured to a different one of first tab 126 and the second tab 128. The first stiff and flexible elongated rod 122 defines the top of the pouch 130 and the second stiff and flexible elongated rod 124 can give it a more desirable shape.

Figure 3:
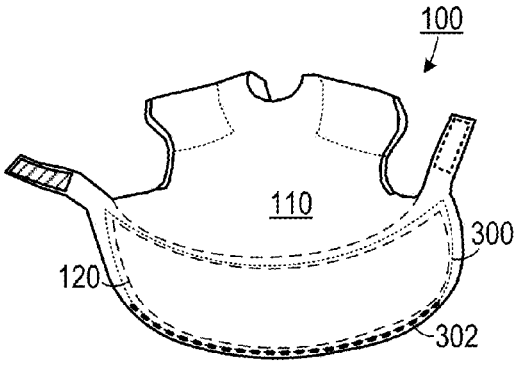
FIG. 3 is an elevational view of an embodiment with a pocket to hold a support structure.

As shown in FIG. 3, in one embodiment a pocket 300 is formed in the lower portion of the flexible body member 110. The pocket 300 opens with a closure such as a zipper 302 (which can be disposed, for example, at the bottom of the flexible body member 110, can be disposed along a side thereof or in the middle thereof), a hook and loop fastener or other similar fasters well known to those of skill in the art. The pocket 300 holds the collapsible support structure 120 therein so that the collapsible support structure 120 can be removed when the flexible body member 110 is washed.

Figure 4A:
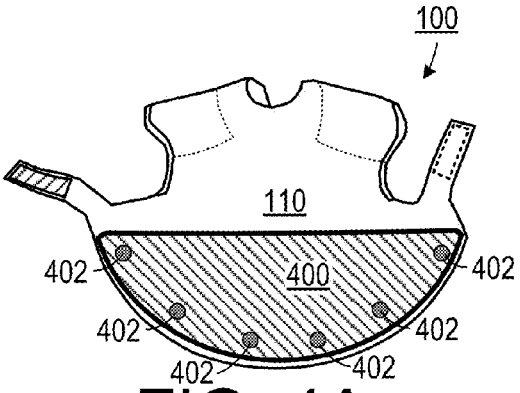
FIGS. 4A-4B are elevational views of an embodiment with a flap that forms a pocket
Figure 4B:
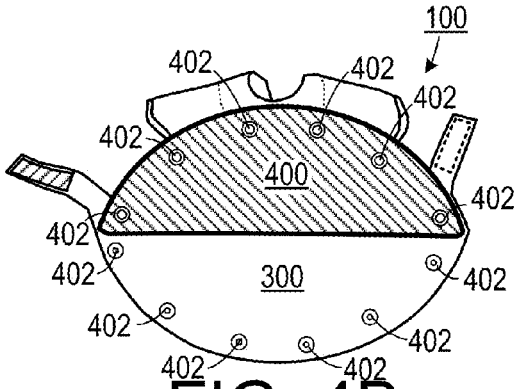

In one alternate embodiment, as shown in FIGS. 4A and 4B, the pocket can be formed by a flap 400 that can be closed (as shown in FIG. 4A) and secured, for example with snaps 402, a hook and loop fastener and the like.

Figure 5A:
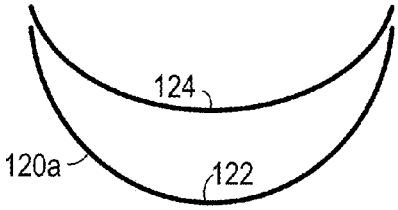
FIGS. 5A-5C are elevational views of support structures.
Figure 5B:
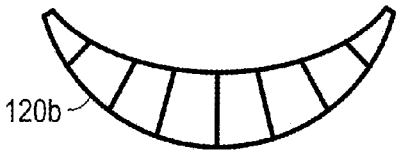
Figure 5C:
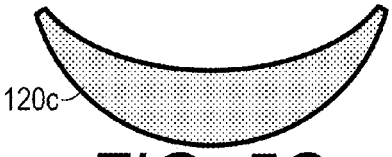

Many different configurations of suitable collapsible support structures are possible, several of which are shown in FIGS. 5A-5C. In FIG. 5A, a two independent rod system 120*a* is shown and FIG. 5B shows a system 120*b* that includes two rods connected by a plurality of transverse rods that provide extra support to the pocket. A solid sheet plastic configuration 120*c* is shown in FIG. 5C.

In one embodiment, a bib according to the invention can be formed from a single plastic sheet and additional plastic in a single mold.

The bib is designed to catch debris and can be used by babies, children, or adults. When worn, the lower section can be folded and attached behind the back to form a pocket. When not in use, the bib can be fully folded or wadded up and placed into a bag or left lying flat. The bib will again take its shape when worn.

The bib may be shaped like an apron. It can be made from either one piece of material or a top & bottom part, where the bottom part is in the shape of a half moon and the top part can have sleeves (short or long) or none at all. The sleeves may be cut as a part of the pattern (as one piece) then folded over to create a sleeve loop and sewn down to the main part of the bib. Two flexible (curved or straight) plastic rods may form the pouch. One rod may be attached to the outer rim. A second middle rod, located between the rim and waist, may also be sewn into the fabric for extra support and firmness. The two rods can meet and attach to the back straps. In one embodiment, wires from the rods extend into or onto the straps at least 1.5 inches to create the resistance to form the pocket. Slightly twisting the straps, which can be done in one motion with a flick of the wrists while attaching the back strap, can make the bib stand even further out because of the torque.

One experimental embodiment was made using polyester covered boning for sewing as the rods. Such boning is often used in the sewing of a ladies corsets and the like. In this experimental embodiment, to construct the pocket, two identical half-moons were first cut out. Next, two strips of boning for the rim and mid sections were attached by sewing the polyester covering of the boning directly to the 1st half moon, then attached the second moon to the first. Lastly, stitches were made both around the outer exterior and then also outlined the two rods so that there was not a large air pocket between the two half-moons. Bias tape was attached for esthetic purposes to create the orange edging around the bib. Other ways to attach the wire may be used, such as with bias tape or creating a pocket where the rods can slipped in.

Other considerations include the fact that that the apron shape may be made as one piece or two (top and bottom half moon). One embodiment uses two strands of flexible material to form the pocket. However, more or fewer strands may be employed. In another embodiment, multiple smaller perpendicular rods may be used as support instead of the second curved rod. Any rod (straight to curved) attached to the rim, in which attaching causes the rod to curve 180 degrees may be used. Having rod(s) attached to the outer rim that attaches to straps which go behind the back may be employed. This facilitates the forming of the pouch when in use.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A bib for wearing by a user having a torso, comprising:

(a) a liquid resistant flexible body member having a bottom configured to cover the torso of the user, the bottom extending to a lower periphery, the flexible body member defining a pocket adjacent the bottom;

(b) a closure system configured to engage the flexible body member around the torso of the user; and (c) a separate collapsible support structure removably disposed inside the pocket of the flexible body member and directly coupled to the closure, the collapsible support structure having a first state that supports the flexible body member as an open pouch at the bottom of the flexible body member when the closure is engaged with the torso of the user, the collapsible support structure also having a second state in which the collapsible support structure and the flexible body member are substantially flat when the closure is not engaged with the torso of the user.

2. The bib of claim 1, wherein the collapsible support structure fits into the pocket, the pocket configured to allow the collapsible support structure to be removable therefrom to facilitate washing of the flexible body member.

3. The bib of claim 2, wherein the pocket is defined by a flap disposed across a portion of the flexible body member, the flap being connectable to the lower periphery of the flexible body member.

4. The bib of claim 3, wherein the flap and the lower periphery of the flexible body member include a plurality of snaps configured to close the pocket.

5. The bib of claim 1, wherein the flexible body member comprises a fabric.

6. The bib of claim 5, wherein the fabric comprises 100% woven polyester fabric.

7. The bib of claim 1, wherein the closure system comprises at least one hook and loop fastener in which a hook portion thereof is attached to a first side of the flexible body member and in which a loop portion thereof is attached to a second side, opposite from the first side, of the flexible body member.

8. The bib of claim 1, wherein the collapsible support structure comprises a first elongated stiff flexible rib, having a first end and an opposite second end, disposed along the lower periphery of the flexible body member and that has a first state that forms a substantially circular rim configured to support a portion of the bottom of the flexible body member in the shape of a pouch when the closure system draws the first end next to the second end and that has a second state that is substantially straight when the closure system is not engaged.

9. The bib of claim 8, further comprising a second elongated stiff flexible rib disposed substantially parallel to the first elongated stiff flexible rib and configured to support an inner top portion of the pouch.

10. The bib of claim 9, further comprising a plurality of spaced apart stiff flexible ribs disposed transversely to the first elongated stiff flexible rib and the second elongated stiff flexible rib and connected thereto, so that when the closure system is engaged the plurality of spaced apart stiff flexible ribs provide support to a bottom of the pouch.

11. A bib system, comprising:

(a) a liquid resistant flexible body member having a bottom configured to cover a torso of a user, the bottom extending to a lower periphery, the flexible body member defining a pocket adjacent the bottom;

(b) a closure system configured to engage the flexible body member around the torso of the user; and (c) a separate collapsible support structure removably disposed inside the pocket and directly coupled to the closure, the collapsible support structure having a first state that supports the flexible body member as an open pouch at the bottom of the flexible body member when the closure is engaged with the torso of the user, the collapsible support structure also having a second state in which the collapsible support structure and the flexible body member are substantially flat when the closure is not engaged with the torso of the user, the collapsible support structure having a size so as to fit into the pocket, the collapsible support structure including a first elongated stiff flexible rib, having a first end and an opposite second end, disposed along the lower periphery of the flexible body member having a shape that forms a substantially circular rim that supports a portion of the bottom of the flexible body member in the shape of a pouch when the closure system draws the first end next to the second end, wherein the pocket is structured so as to allow the collapsible support structure to be removable therefrom to facilitate washing of the flexible body member.

12. The bib system of claim 11, wherein the pocket is defined by a flap disposed across a portion of the flexible body member, the flap being connectable to the lower periphery of the flexible body member.

13. The bib system of claim 11, wherein the flexible body member comprises a 100% woven polyexter fabric.

14. The bib system of claim 11, wherein the closure system comprises at least one hook and loop fastener in which a hook portion thereof is attached to a first side of the flexible body member and in which a loop portion thereof is attached to a second side, opposite from the first side, of the flexible body member.

15. The bib system of claim 11, further comprising a second elongated stiff flexible rib disposed substantially parallel to the first elongated stiff flexible rib and configured to support an inner top portion of the pouch.

16. The bib system of claim 11, further comprising a plurality of spaced apart stiff flexible ribs disposed transversely to the first elongated stiff flexible rib and the second elongated stiff flexible rib and connected thereto, so that when the closure system is engaged the plurality of spaced apart stiff flexible ribs provide support to a bottom of the pouch.

* * * * *